US007850279B2

(12) United States Patent
Usami et al.

(10) Patent No.: US 7,850,279 B2
(45) Date of Patent: Dec. 14, 2010

(54) LIQUID DROPLET EJECTING HEAD AND LIQUID DROPLET EJECTING APPARATUS

(75) Inventors: Hiroyuki Usami, Kanagawa (JP); Yoshinao Kondoh, Kanagawa (JP); Toshinobu Hamazaki, Kanagawa (JP); Nanao Inoue, Kanagawa (JP); Akira Mihara, Kanagawa (JP); Naoki Morita, Kanagawa (JP); Hiroshi Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 776 days.

(21) Appl. No.: 11/820,919

(22) Filed: Jun. 21, 2007

(65) Prior Publication Data

US 2008/0024554 A1 Jan. 31, 2008

(30) Foreign Application Priority Data

Jul. 28, 2006 (JP) ..... 2006-206535

(51) Int. Cl.
*B41J 2/14* (2006.01)

(52) U.S. Cl. ..... 347/50

(58) Field of Classification Search ..... 347/50, 347/68–72

See application file for complete search history.

(56) References Cited

U.S. PATENT DOCUMENTS 5,604,522 A * 2/1997 Miura et al. ..... 347/70
7,271,478 B2 * 9/2007 Ito ..... 257/686

FOREIGN PATENT DOCUMENTS

JP 2000-289204 10/2000

* cited by examiner

*Primary Examiner*—An H Do
(74) *Attorney, Agent, or Firm*—Fildes & Outland, P.C.

(57) ABSTRACT

A liquid droplet ejecting head including: a piezoelectric element that includes a piezoelectric body, a first electrode disposed on one side of the piezoelectric body, and a second electrode disposed on the other side of the piezoelectric body; a first layer on one side of which the second electrode of the piezoelectric element is disposed; a second layer disposed on the other side of the first layer; a first electrical wire formed between the first layer and the second layer; and a second electrical wire that connects the first electrical wire and the second electrode, is provided.

17 Claims, 18 Drawing Sheets

LIQUID DROPLET EJECTING HEAD AND LIQUID DROPLET EJECTING APPARATUS

CROSS-REFERENCE TO RELATED APPLICATION

This application is based on and claims priority under 35 USC 119 from Japanese Patent Application No. 2006-206535 filed Jul. 28, 2006.

BACKGROUND

1. Technical Field

The present invention relates to a liquid droplet ejecting head and a liquid droplet ejecting apparatus.

2. Related Art

Conventionally, piezo type inkjet recording apparatus (liquid droplet ejecting apparatus) that selectively ejects ink droplets from plural nozzles of an inkjet recording head (liquid droplet ejecting head) to form an image (including characters) on a recording medium such as recording paper has been known.

SUMMARY

A liquid droplet ejecting head of an aspect of the invention includes: a piezoelectric element that includes a piezoelectric body, a first electrode disposed on one side of the piezoelectric body, and a second electrode disposed on the other side of the piezoelectric body; a first layer on one side of which the second electrode of the piezoelectric element is disposed; a second layer disposed on the other side of the first layer; a first electrical wire formed between the first layer and the second layer; and a second electrical wire that connects the first electrical wire and the second electrode.

BRIEF DESCRIPTION OF THE DRAWINGS

Exemplary embodiments of the invention will be described in detail with reference to the following figures, wherein.

DETAILED DESCRIPTION

Figure 1:
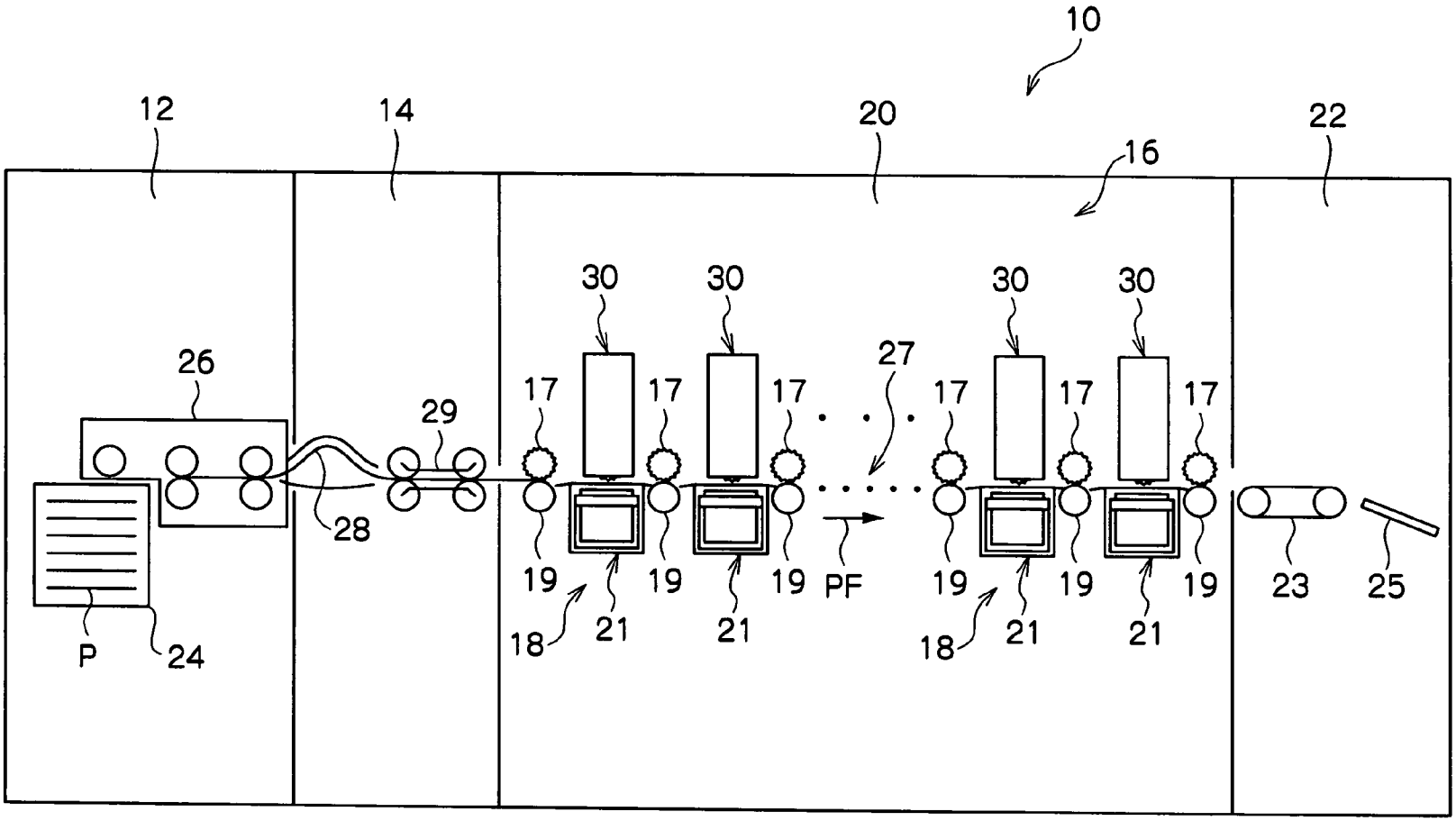
FIG. 1 is a general front diagram showing an inkjet recording apparatus.

The exemplary embodiments will be described in detail below with drawings. The liquid droplet ejecting apparatus will be described by way of an inkjet recording apparatus 10 as an example. Consequently, the liquid will be described by way of ink N, the liquid droplet ejecting head will be described by way of an inkjet recording head 32, and the recording medium will be described by way of a recording paper P. Further, when arrow UP and arrow DO are shown in the drawings, the direction represented by arrow UP will be an up direction and the direction represented by arrow DO will be a down direction.

As shown in FIG. 1, the inkjet recording apparatus 10 is basically configured by a paper supply section 12 that feeds recording paper P, a registration adjustment section 14 that controls the orientation of the recording paper P, a recording section 20 provided with a recording head section 16 that ejects ink droplets to form an image on the recording paper P and a maintenance section 18 that performs maintenance with respect to the recording head section 16, and a discharge section 22 that discharges the recording paper P on which an image has been formed by the recording section 20.

The paper supply section 12 is configured by a paper supply portion 24 in which the recording paper P is stored and by a conveyance device 26 that picks up the recording paper P from the paper supply portion 24 one sheet at a time and conveys the recording paper P to the registration adjustment section 14. The registration adjustment section 14 includes a loop forming portion 28 and a guide member 29 that controls the orientation of the recording paper P. The recording paper P passes through this portion, whereby skewing is corrected utilizing the body thereof, the conveyance timing is controlled, and the recording paper P is supplied to the recording section 20. Then, the discharge section 22 accommodates in a paper discharge portion 25 via a paper discharge belt 23, the recording paper P on which an image has been formed by the recording section 20.

A paper conveyance path 27 on which the recording paper P is conveyed is configured between the recording head section 16 and the maintenance section 18 (the paper conveyance direction is represented by arrow PF). The paper conveyance path 27 include star wheels 17 and conveyance rolls 19, and the recording paper P is continuously (without stopping) conveyed while being nipped and held by the star wheels 17 and the conveyance rolls 19. Then, ink droplets are ejected from the recording head section 16 with respect to the recording paper P and an image is formed on the recording paper P. The maintenance section 18 includes maintenance devices 21 that are disposed facing inkjet recording units 30 and perform processing such as capping, wiping, dummy jetting and vacuuming with respect to inkjet recording heads 32.

Figure 2:
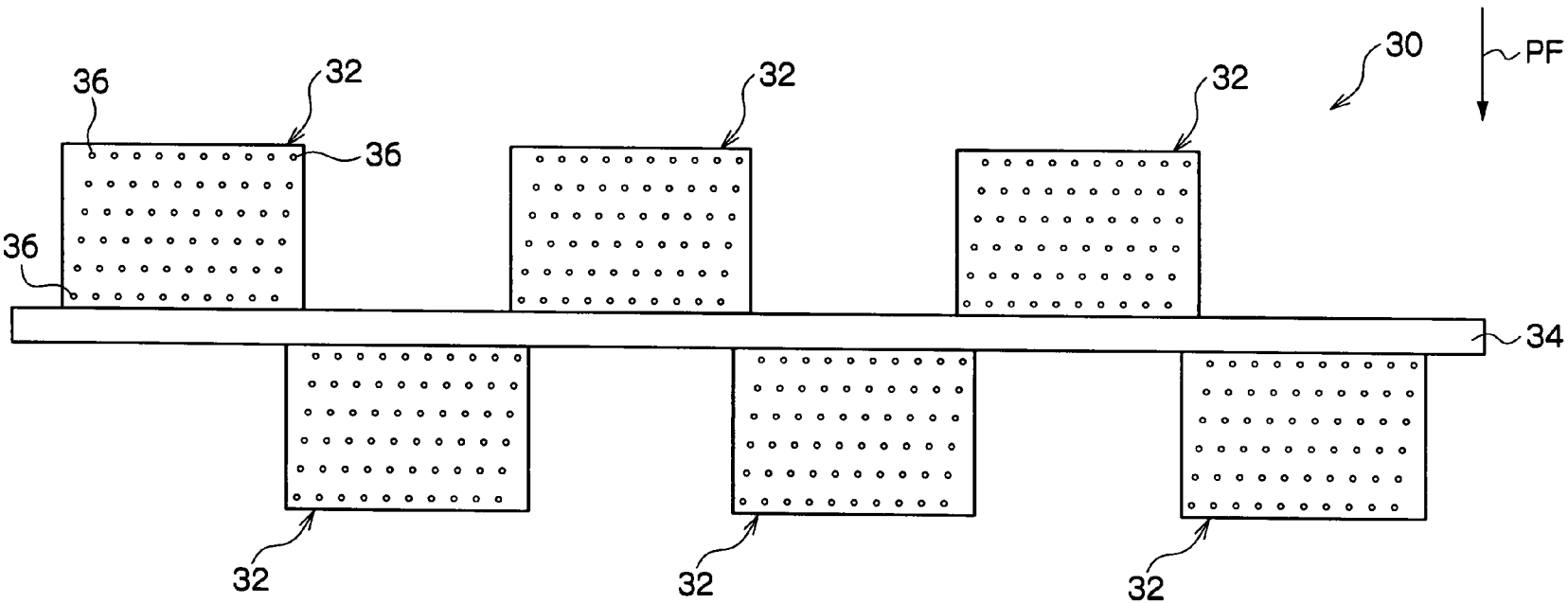
FIG. 2 is an explanatory diagram showing the arrangement of inkjet recording heads.

As shown in FIG. 2, each of the inkjet recording units 30 is provided with a support member 34 that is disposed in a direction intersecting (orthogonal to) the paper conveyance direction represented by arrow PF, and plural inkjet recording heads 32 are attached to the support member 34. Plural nozzles 36 are formed in a matrix in each of the inkjet recording heads 32, and the nozzles 36 are arranged in the width direction of the recording paper P at a pitch that is constant overall in the inkjet recording unit 30.

Additionally, ink droplets are ejected from the nozzles 36 with respect to the recording paper P continuously conveyed on the paper conveyance path 27, whereby an image is recorded on the recording paper P. It will be noted that at least four of the inkjet recording units 30 are disposed in correspondence to the respective colors of yellow (Y), magenta (M), cyan (C) and black (K) in order to record a full-color image, for example.

Figure 3:
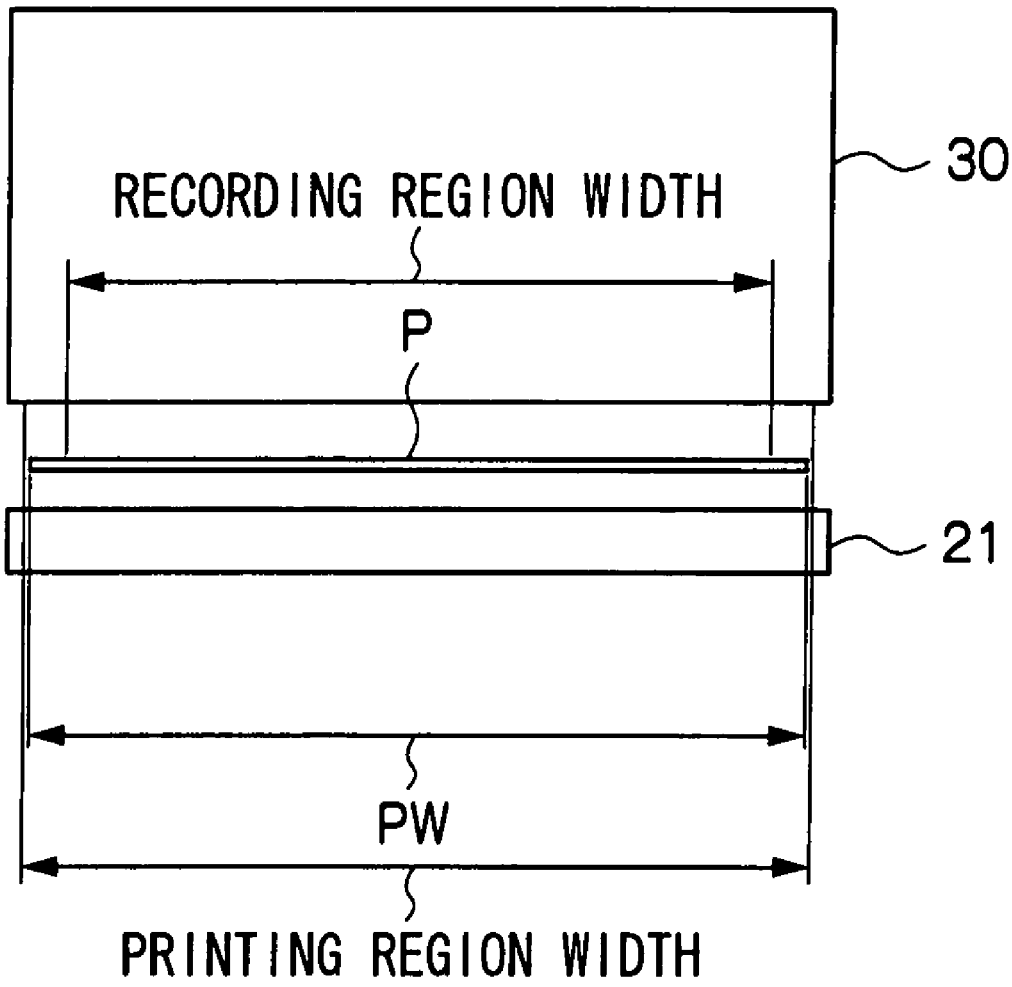
FIG. 3 is an explanatory diagram showing the relationship between the width of a recording medium and the width of a printing region.

As shown in FIG. 3, the width of the printing region resulting from the nozzles 36 of each of the inkjet et recording units 30 is longer than the maximum paper width PW of the recording paper P for which image recording by the inkjet recording apparatus 10 is assumed, so that image recording across the entire width of the recording paper P is enabled without moving the inkjet recording units 30 in the paper width direction.

Here, "width of the printing region" basically means the maximum recording region among recording regions excluding the unprinted margins from both ends of the recording paper P, but typically the width of the printing region is greater than the maximum paper width PW to be printed. Thus, the inkjet recording apparatus 10 can accommodate the recording paper P being conveyed while slanted (skewed) a predetermined angle with respect to the conveyance direction and borderless printing.

Figure 4:
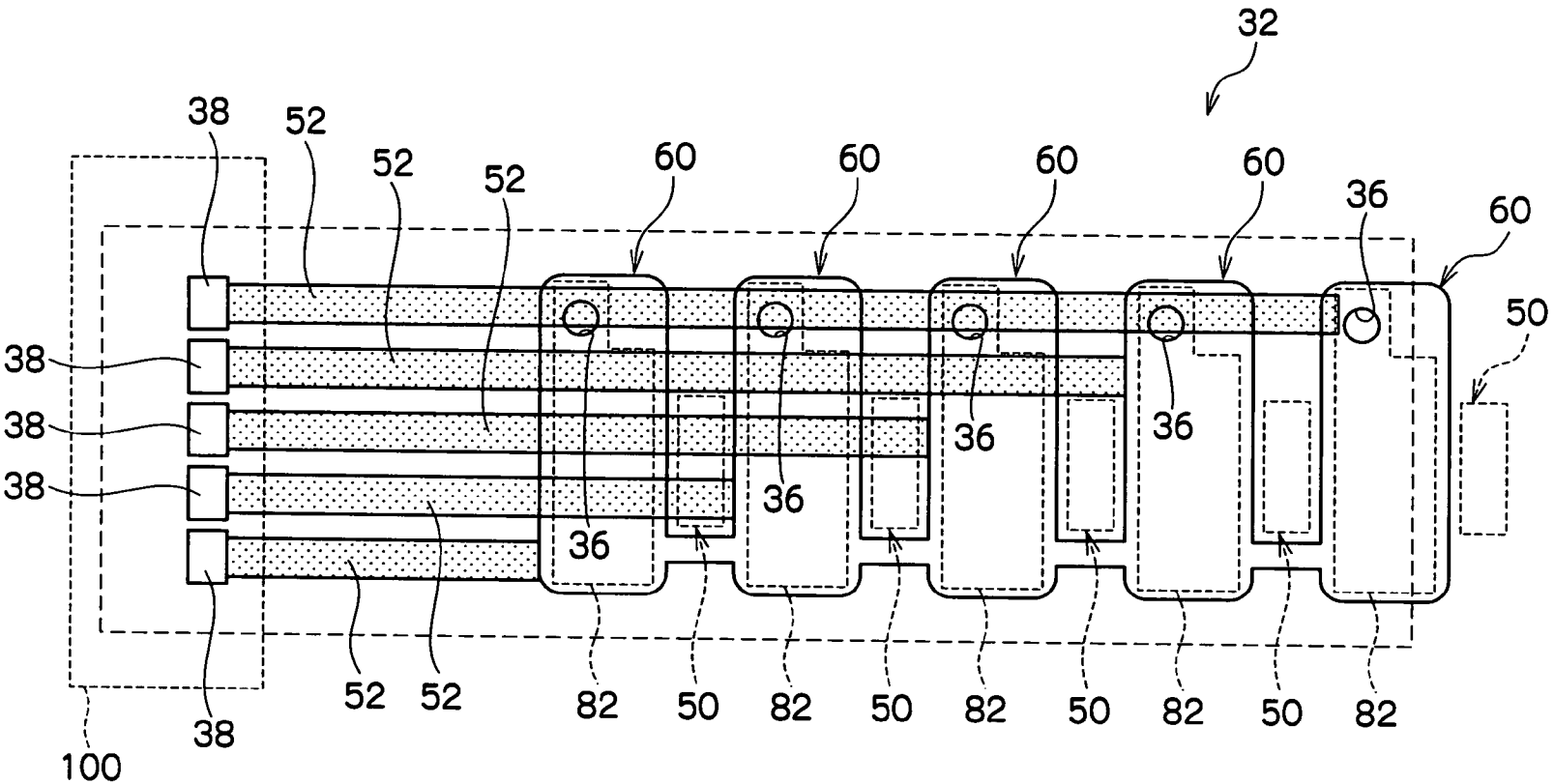
FIG. 4 is a general plan diagram schematically showing the configuration of a first exemplary embodiment of an inkjet recording head.
Figure 5:
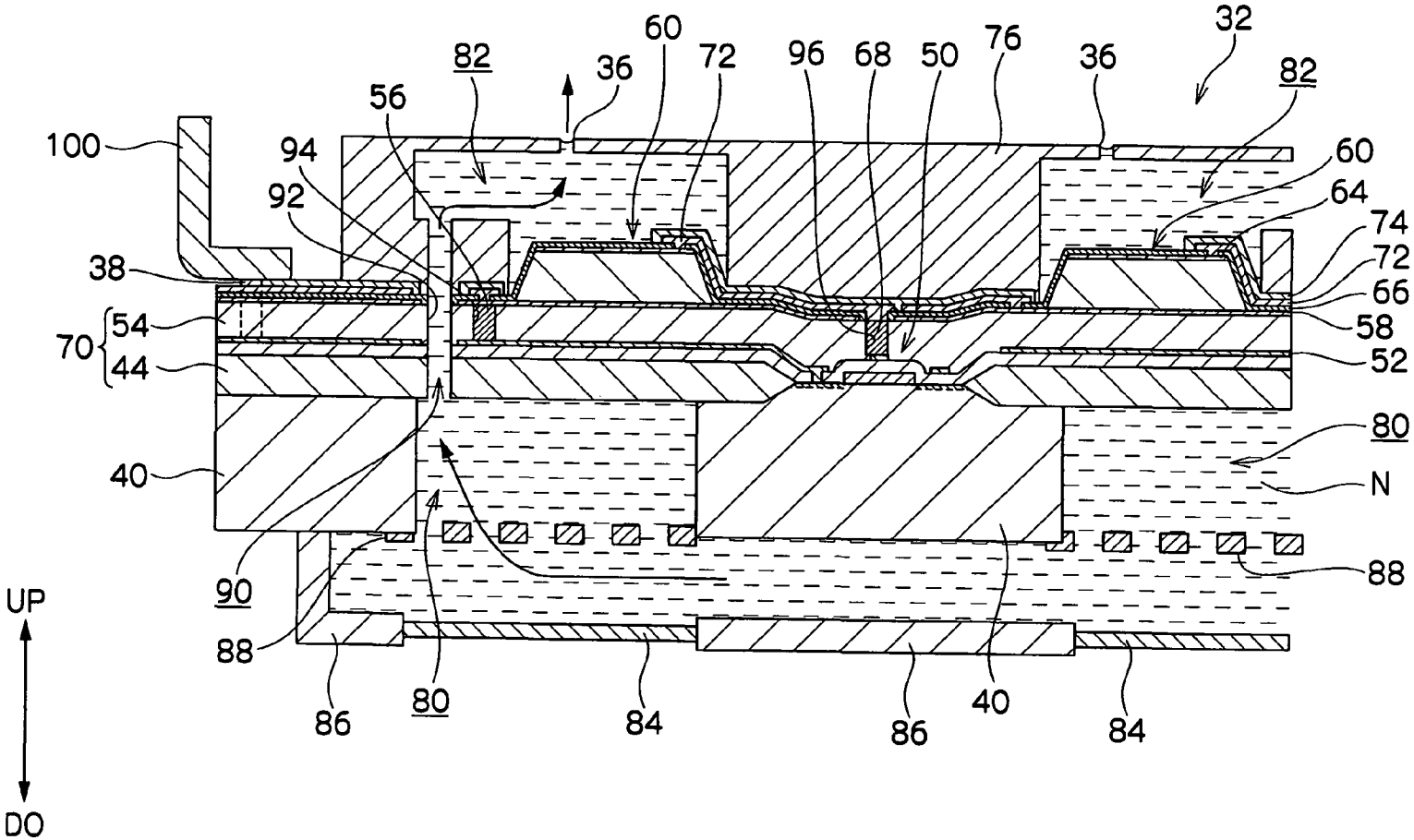
FIG. 5 is a general cross-sectional diagram showing the configuration of the first exemplary embodiment of the inkjet recording head.

Next, a first exemplary embodiment of the inkjet recording head 32 will be described. FIG. 4 is a general plan diagram schematically showing the configuration of the inkjet recording head 32. Further, FIG. 5 is a general cross-sectional diagram showing part of the inkjet recording head 32 such that its main portion is clear. It will be noted that in FIG. 5 a state is shown where the inkjet recording head 32 is upside down, and here the inkjet recording head 32 will be described referring to the side where the nozzles 36 are formed as the top side.

As shown in FIG. 4 and FIG. 5, the inkjet recording head 32 is configured as a result of vibrating plates 70, piezoelectric elements 60 and drive elements 50 being disposed on a silicon substrate 40. A lower electrode 58 serving as a second electrode having one polarity is disposed on the undersurface of the piezoelectric element 60, and an upper electrode 64 serving as a first electrode having another polarity is disposed on the upper surface of the piezoelectric element 60.

The vibrating plate 70 is primarily configured by a tetraethoxysilane film (called "TEOS film" below) 54 serving as a first layer that is formed by chemical vapor deposition (CVD) method and a local-oxidation-of-silicon film (called "LOCOS film" below) serving as a second layer. The vibrating plate 70 has elasticity at least in the vertical direction and flexibly deforms in the vertical direction when electricity is supplied (when a voltage is applied) to the piezoelectric element 60.

A metal wire 52 serving as a first electrical wire is disposed inside the vibrating plate 70 (i.e., between the TEOS film 54 and the LOCOS film 44), and a metal wire 72 serving as a third electrical wire that connects to the upper electrode 64 is disposed above the drive element 50. Additionally, electrical connection through openings 94 and 96 for respectively electrically connecting the metal wire 52 and the lower electrode 58 and also the metal wire 72 (the upper electrode 64) and the drive element 50 are formed in the vibrating plate 70 (the TEOS film 54).

As a second electrical wire, the inside of the electrical connection through opening 94 is filled with a high-melting-point metal—e.g., tungsten 56—whose melting point is 600° C. or higher, whereby the metal wire 52 and the lower electrode 58 are electrically connected. The inside of the electrical connection through opening 96 is also filled with tungsten 68, whereby the metal wire 72 (the upper electrode 64) and the drive element 50 are electrically connected.

A manifold 86 configured by an ink-resistant material is joined to the undersurface side of the silicon substrate 40, and an ink pool chamber 80 having a predetermined shape and volume is formed between the manifold 86 and the vibrating plate 70. An ink supply port (not shown) connected to an ink tank (not shown) is disposed in a predetermined part of the manifold 86, and the ink N filled from the ink supply port is retained in the ink pool chamber 80. It will be noted that an air damper 84 is provided in the manifold 86 so that vibration resulting from ink-jetting does not affect the other nozzles 36 (in order to prevent crosstalk).

An ink filter 88 is disposed in the ink pool chamber 80 in order to remove dust and the like in the ink N. Additionally, a pressure chamber 82 filled with the ink N supplied from the ink pool chamber 80 is formed above the piezoelectric element 60, and the ink pool chamber 80 and the pressure chamber 82 are connected by an ink supply path 90 (an ink supply through opening 92). Consequently, the volume of the pressure chamber 82 is increased and decreased by vibration of the vibrating plate 70 to generate a pressure wave, whereby ink droplets are ejected from the nozzle 36.

Further, the ink pool chamber 80 and the pressure chamber 82 are configured such that they are not present in the same horizontal plane. Thus, the pressure chambers 82 can be disposed in a state where they are near mutually, and the nozzles 36 can be disposed in a high density in a matrix. In addition, a flexible printed board (called "FPC" below) 100 is connected to the metal wire 52 via a bump 38.

Figures 6A, 6B, 6C:
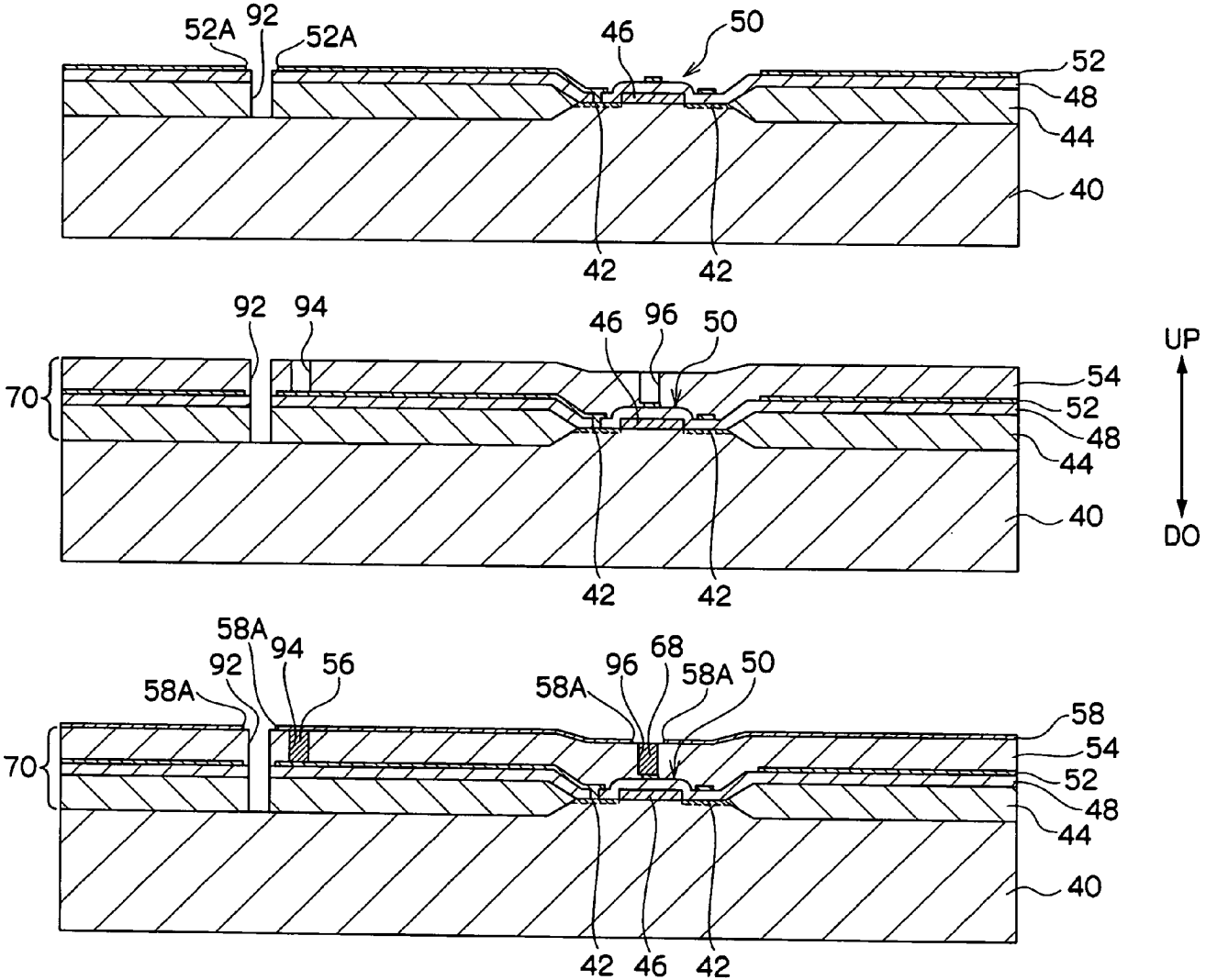
FIGS. 6A to 6C are explanatory diagrams showing the process of manufacturing the inkjet recording head.

Next, the process of manufacturing the inkjet recording head 32 of the first exemplary embodiment will be described in detail on the basis of FIG. 6A to FIG. 12M. First, as shown in FIG. 6A, the drive element 50 that is a control circuit of the piezoelectric element 60 is manufactured on the silicon substrate 40. A commonly known manufacturing method is used for the method of manufacturing the drive element 50.

That is, the LOCOS film 44 (film thickness: 0.7 μm) is formed in a region on the silicon substrate 40 excluding impurity ($N^+$) diffusion region 42, and polysilicon 46 is formed on the silicon substrate 40 in the impurity ($N^+$) diffusion region 42. Then, a boron-phosphorus-silicon-glass film (called "BPSG film" below; film thickness of 0.5 μm) 48 is formed on the impurity ($N^+$) diffusion region 42, the LOCOS film 44 and the polysilicon 46.

Next, the high-melting-point metal wire 52 (film thickness: 0.5 μm) of a high-temperature-resisting metal such as Ta, Ti, W, or Pt is formed on the upper surface of the BPSG film 48 such that there is an individual wire for each of the piezoelectric elements 60 (see FIG. 4). It will be noted that the ink supply through opening 92 for forming the ink supply path 90 is formed in each process in a predetermined position in the LOCOS film 44, the BPSG film 48 and the metal wire 52. Further, the range in which the electrical wire 52 is formed is as far as a predetermined position that does not reach the ink supply-use through opening 92.

Thereafter, as shown in FIG. 6B, the TEOS film 54 (film thickness: 3.3 μm) is formed. Thus, the thickness of the vibrating plate 70 configured by the LOCOS film 44, the BPSG film 48 and the TEOS film 54 is 5 μm to 7 μm, for example. It will be noted that, at this time, the end portion 52A of the metal wire 52 near the ink supply-use through opening 92 is covered by the TEOS film 54 to ensure that the metal wire 52 is not exposed to the ink supply-use through opening 92. Further, the electrical connection through opening 94 for electrically connecting the metal wire 52 and the lower electrode 58 and the electrical connection through opening 96 for electrically connecting the drive element 50 and the upper electrode 64 are formed in the TEOS film 54.

Here, with respect to the films laminated as the vibrating plate 70, a film other than the TEOS film 54 may be used as long as it is a film of low stress and in which cracks and the like do not occur even when formed at several μm or more. Further, in order to alleviate stress, a film to which boron (B), phosphorus (P), germanium (Ge), or the like has been added may also be used. It will be noted that, during formation of the vibrating plate 70, when the region where the piezoelectric element 60 is to be formed is uneven, a planarizing technique such as polishing or etching-back may be used to create a flat surface with a surface roughness (Ra) of 1 μm or less.

Thereafter, as shown in FIG. 6C, the tungsten 56 and the tungsten 68 are respectively deposited in the electrical connection through openings 94 and 96, and a Ti film (film thickness: 10 nm) and a Pt film (film thickness: 250 nm) that become the lower electrode 58 are consecutively formed on the TEOS film 54 by sputtering. It will be noted that the range in which the lower electrode 58 is formed is as far as a predetermined position that does not reach the ink supply through opening 92 and the electrical connection through opening 96. Further, the filling of the electrical connection through openings 94 and 96 with the tungsten 56 and 68 is performed by depositing the tungsten 56 and 68 and thereafter polishing after forming Ti/TiN (not shown) that is a barrier layer.

Further, here, Pt is used as the lower electrode 58, but another metal such as Ir, Au, or Ru whose affinity with a PZT film 62 configuring the piezoelectric element 60 is high and which is heat-resistant may also be used. Further, an orientation control film (STO, BTO, etc.) and a Ti or $TiO_2$ film as an adhesive layer may also be formed in order to raise the crystalline orientation and adhesiveness of the PZT film 62 to be formed thereafter.

Figure 7D:
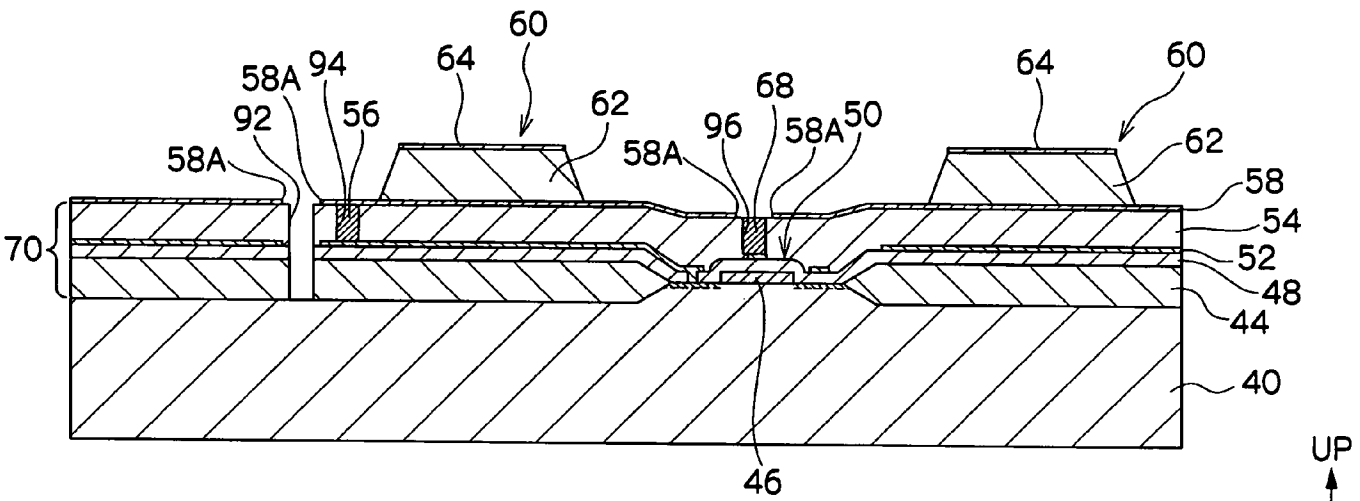
FIGS. 7D and 7E are explanatory diagrams showing the process of manufacturing the inkjet recording head.

Thereafter, as shown in FIG. 7D, the PZT film 62 (film thickness: 5 μm) configuring the piezoelectric element 60 is formed by sputtering, and then a Pt film (film thickness: 0.5 μm) serving as the upper electrode 64 is formed. Then, the PZT film 62 and the upper electrode 64 are patterned by a photolithography step and an etching step. It will be noted that the PZT film 62 that serves as a piezoelectric body may also be formed by another technique such as sol-gel method, Metal Organic chemical vapor deposition (MOCVD), or aerosol deposition (AD). Further, here, Pt is used as the upper electrode 64, but another metal such as Ir, Au, or Ru whose affinity with the PZT film 62 configuring the piezoelectric element 60 is high and which is heat-resistant may also be used.

In this manner, the piezoelectric element 60 is formed, the piezoelectric element 60 is formed above the layer where the metal wire 52 is formed. That is, the metal wire 52 is formed in a layer below the piezoelectric element 60, so that when seen in plan view, the metal wire 52 is formed as an individual wire in the region where the piezoelectric element 60 is formed. Further, the piezoelectric element 60 is formed for each of the drive elements 50 such that the ratio of piezoelectric elements 60 to drive elements 50 is 1:1. That is, the piezoelectric elements 60 and the drive elements 50 are disposed in the same number such that one piezoelectric element 60 is driven by one drive element 50.

Figure 7E:
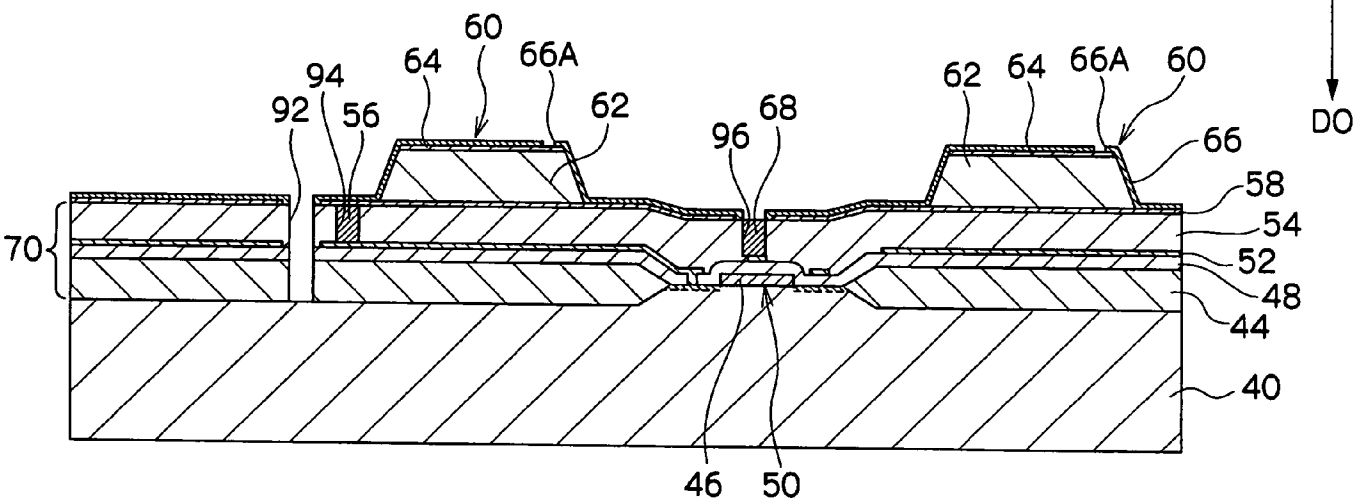

Thereafter, as shown in FIG. 7E, an insulation protection film is formed on the lower electrode 58, the PZT film 62 and the upper electrode 64. That is, a TEOS film 66 (film thickness: 0.5 μm) is formed as an insulation film to avoid a short with the PZT film 62 and as a moisture-resistant protection film of the PZT film 62. It will be noted that, at this time, the end portion 58A of the lower electrode 58 near the ink supply through opening 92 and the end portion 58A of the lower electrode 58 near the electrical connection through opening 96 are covered by the TEOS film 66 to ensure that the lower electrode 58 is not exposed to the ink supply through opening 92 and the electrical connection through opening 96. Further, a contact hole 66A is formed in the TEOS film 66 in order to connect a metal wire 72 (described later) to the upper electrode 64.

Figure 8F:
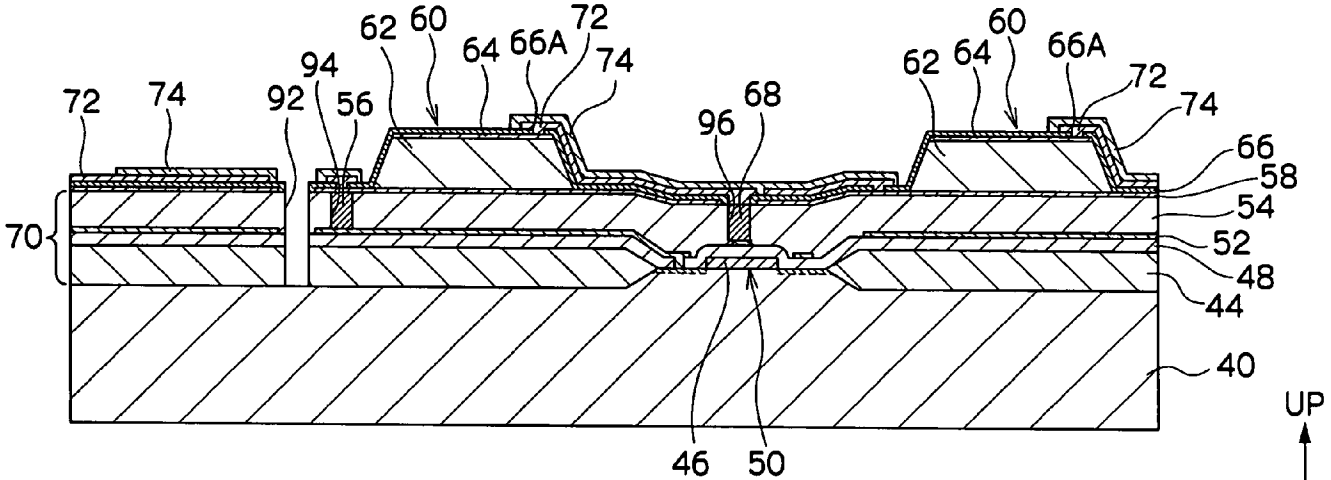
FIGS. 8F and 8G are explanatory diagrams showing the process of manufacturing the inkjet recording head.

Thereafter, as shown in FIG. 8F, the metal wire 72 (film thickness: 1.0 μm) is formed on the upper surface of the TEOS film 66, and the metal wire 72 is connected to the upper electrode 64 via the contact hole 66A and is also connected to the tungsten 68 filled in the electrical connection through opening 96. It will be noted that the metal wire 72 may be a material such as Al or an Al alloy. Then, a wire protection film 74 is formed on the upper surface of the metal wire 72.

The wire protection film 74 may be an oxide film, a nitride film, or a resin film of a polyimide or the like, or may have a two-layer structure including a metal film and an insulation film. Here, a film having a two-layer structure including a SiN film (film thickness: 0.2 μm) and a Ta film (film thickness: 0.5 μm) is used as the wire protection layer 74. Further, application of voltage necessary to drive the piezoelectric element 60 may be done such that the vibrating plate 70 side is as a GND (ground) side or as a + (plus) side.

Figure 8G:
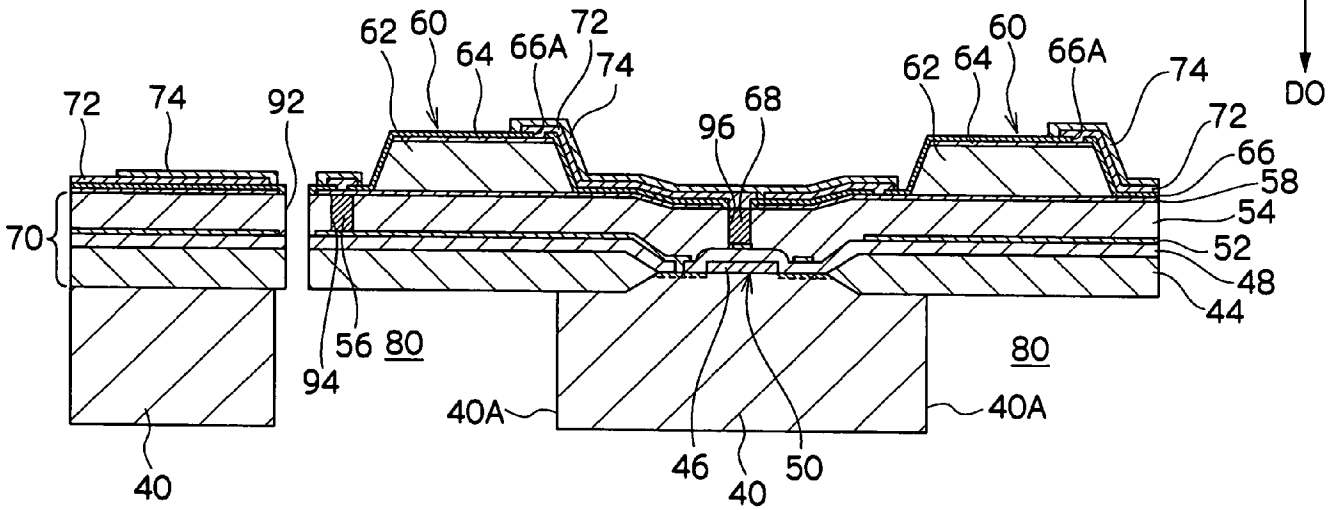
Figure 9H:
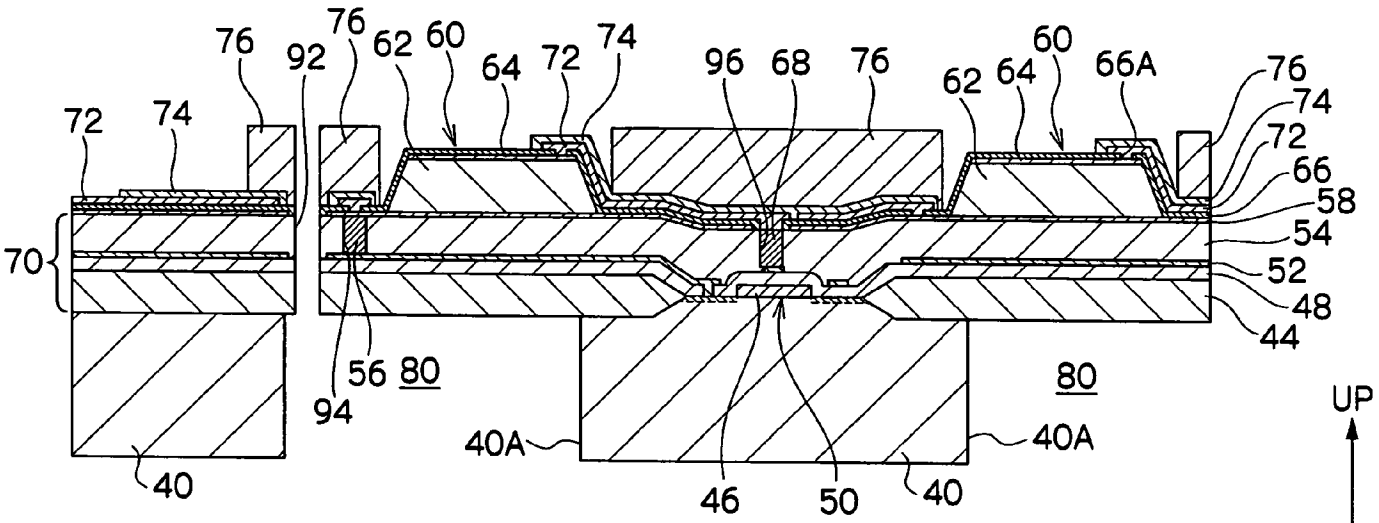
FIGS. 9H and 9I are explanatory diagrams showing the process of manufacturing the inkjet recording head.
Figure 9I:
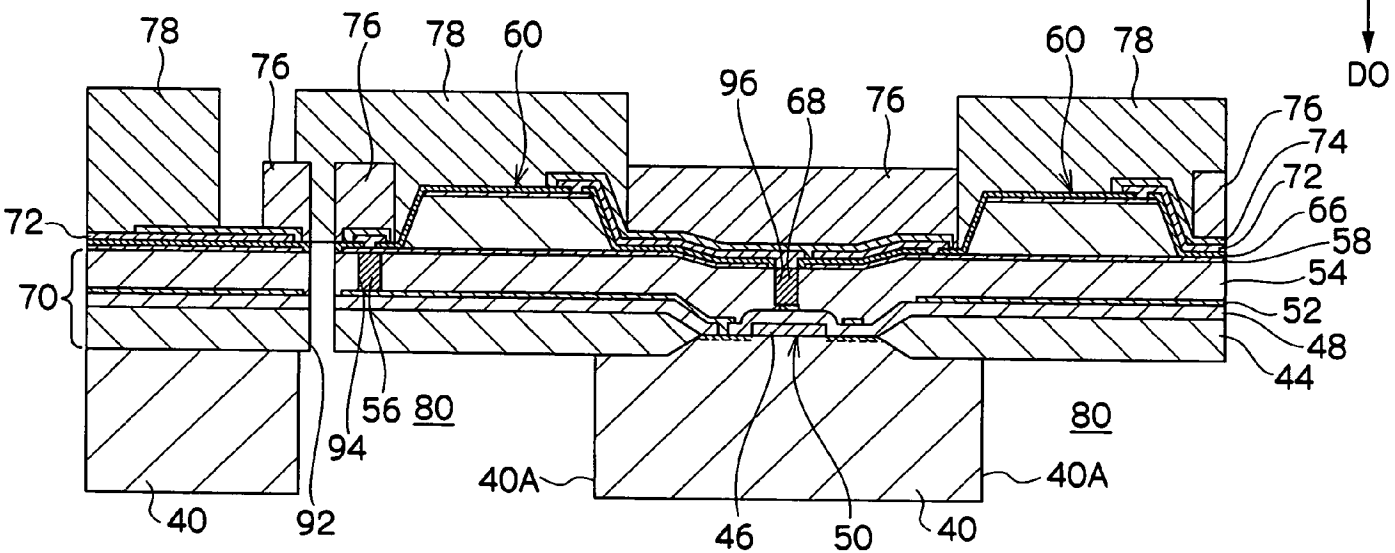

Thereafter, as shown in FIG. 8G, the ink pool chamber 80 is formed. That is, an open portion 40A is formed in a predetermined region in the underside of the silicon substrate 40 by a photolithography process and an etching process. Then, the open portion 40A is connected to the ink supply-use through opening 92 that has already been formed. Next, as shown in FIG. 9H, first, a resin layer 76 of a polyimide or the like is spin-coated and patterned in order to planarize the side wall of the pressure chamber 82. The film thickness of the resin layer 76 may be about 20 μm. Then, as shown in FIG. 9I, a sacrificial resin layer 78 for forming the pressure chamber is spin-coated and patterned. Thus, the sacrificial resin layer 78 is patterned. By these processes, the pressure chamber 82 is patterned such so as to have the desired shape and volume. Here, the thickness of the sacrificial resin layer 78 is 40 μm.

Figure 10J:
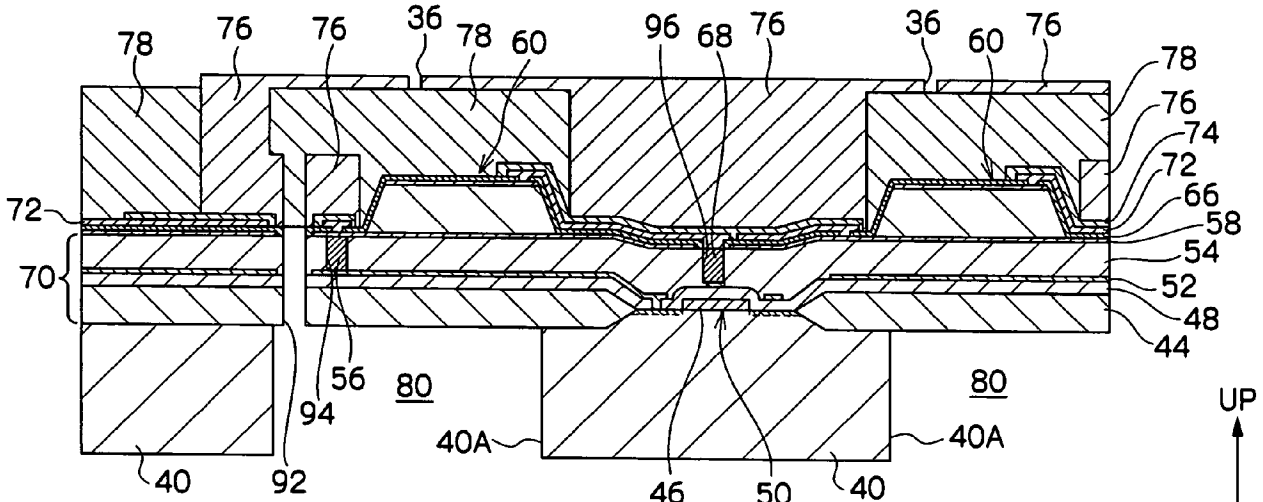
FIGS. 10J and 10K are explanatory diagrams showing the process of manufacturing the inkjet recording head.
Figure 10K:
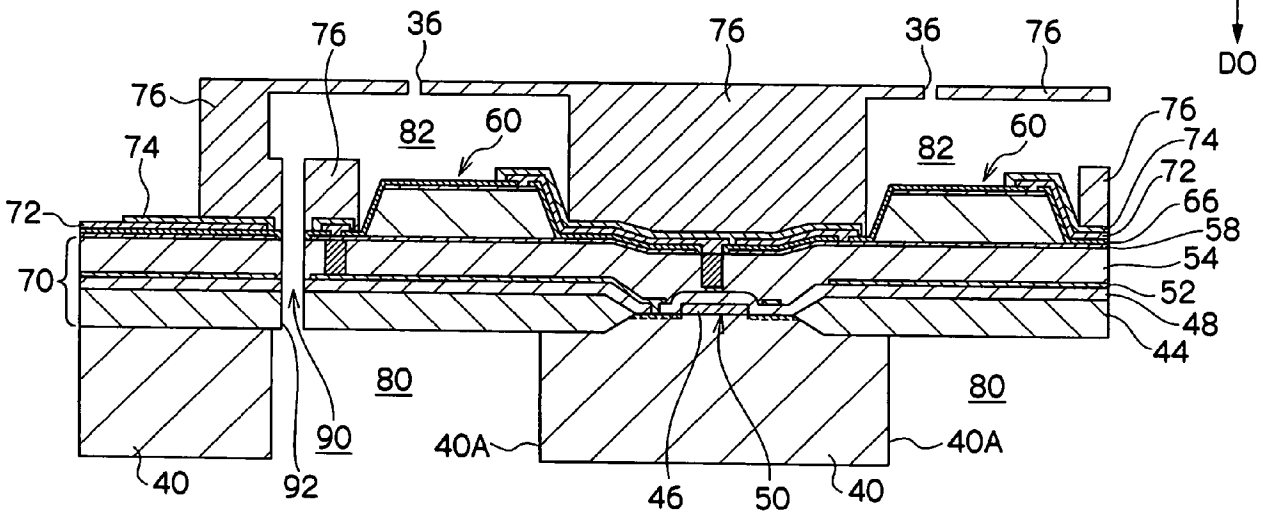
Figure 11L:
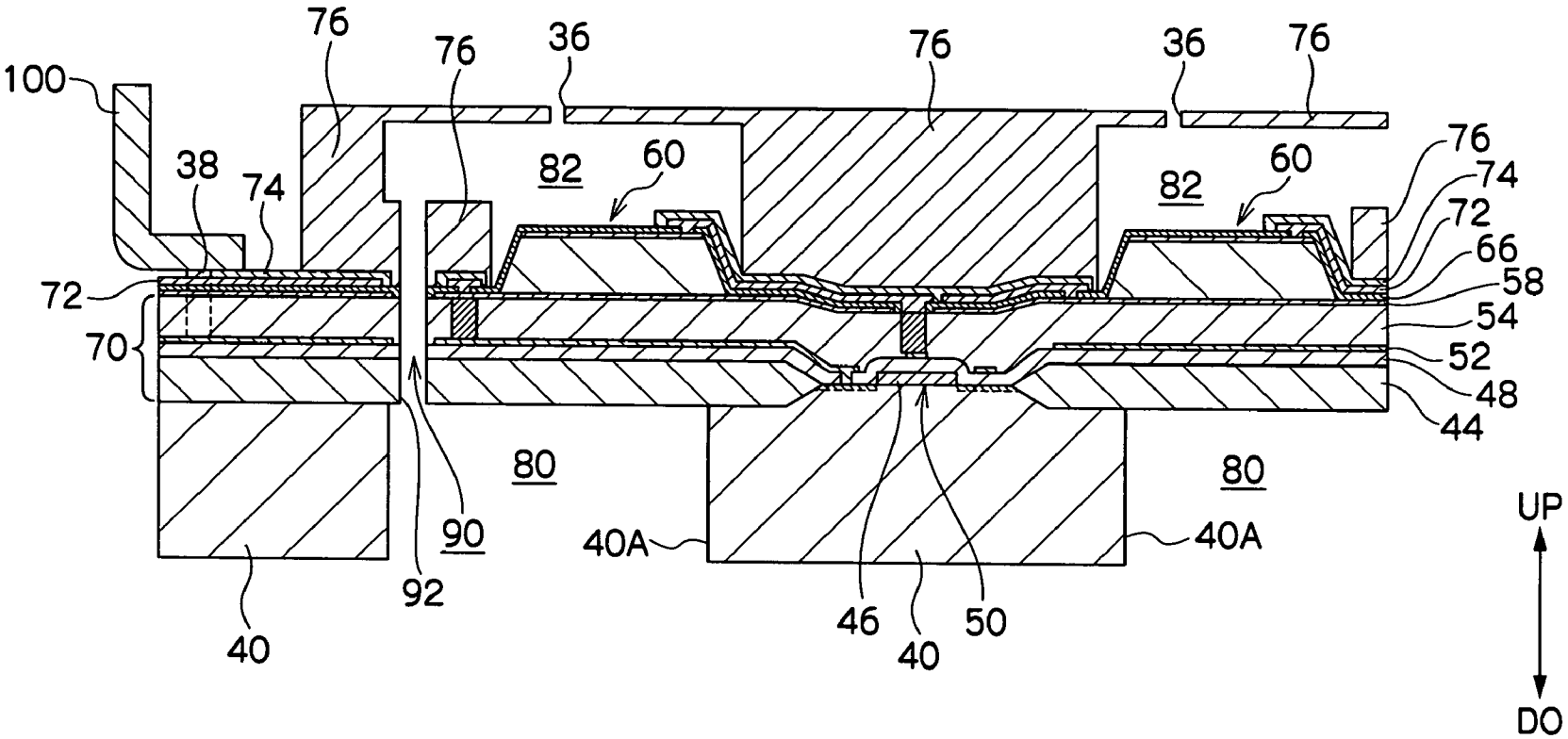
FIG. 11L is an explanatory diagram showing the process of manufacturing the inkjet recording head.

Thereafter, as shown in FIG. 10J, a resin layer 76 is further spin-coated, and patterning for forming the nozzles 36 is performed. It will be noted that the film thickness of the resin layer 76 at this time is 20 μm. Then, as shown in FIG. 10K, the sacrificial resin layer 78 is removed by an organic solvent. Thus, the pressure chamber 82 is formed, and the ink pool chamber 80 and the pressure chamber 82 are connected by the ink supply path 90 (the ink supply through opening 92). Next, as shown in FIG. 11L, the FPC 100 for leading a signal line to the outside is connected to the metal layer 52 via the bump 38.

Figure 12M:
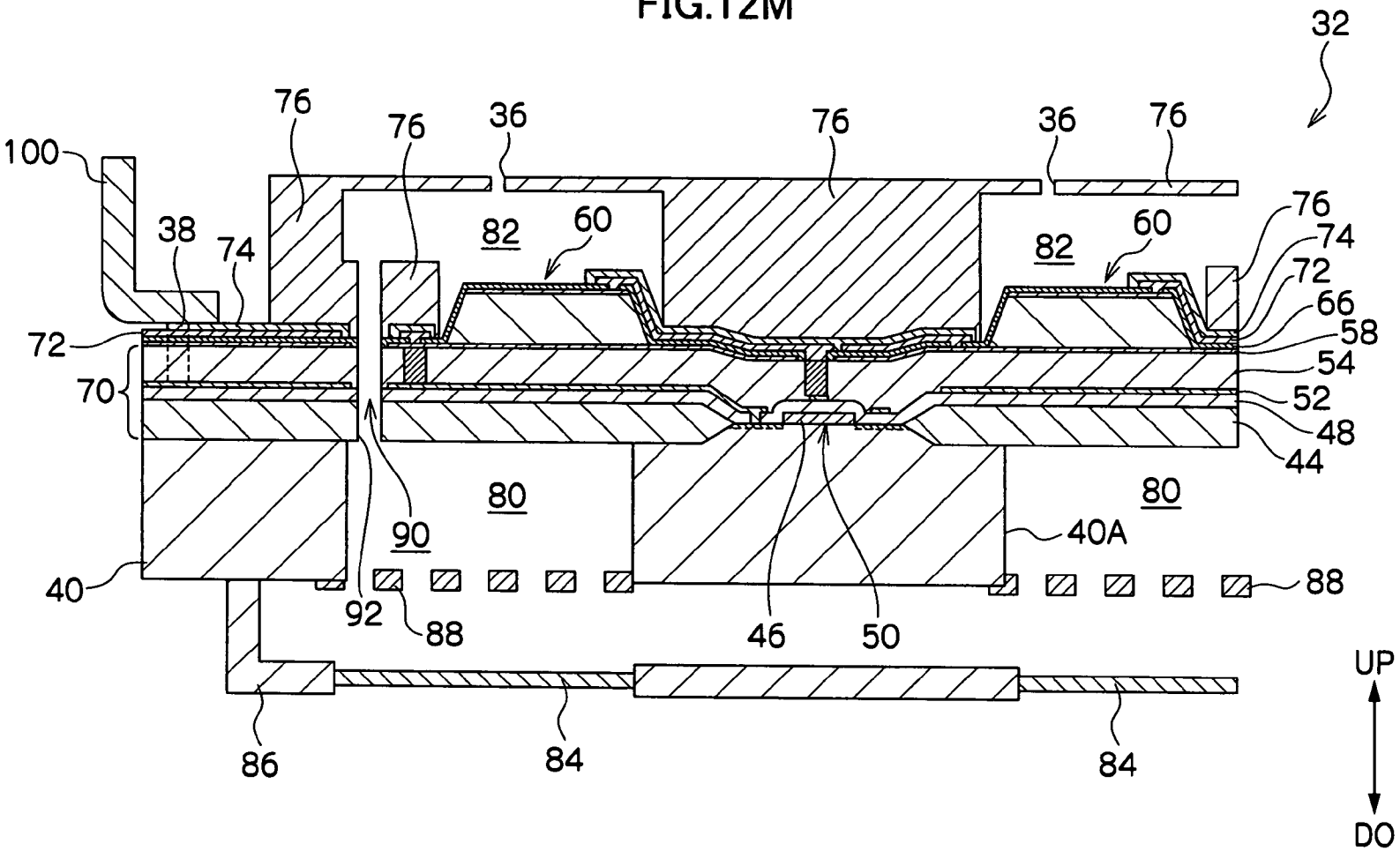
FIG. 12M is an explanatory diagram showing the process of manufacturing the inkjet recording head.

Thereafter, as shown in FIG. 12M, the manifold 86 for supplying ink is joined to the silicon substrate 40. It will be noted that, here, before joining the manifold 86, the ink filter 88 for removing dust and the like in the ink N is disposed in the open portion of the ink pool chamber 80. The ink filter 88 is not particularly limited as long as it is one having the function of being capable of removing dust and the like and has a filter diameter that does not hinder the flow of the ink N; for example, the ink filter 88 may be a resin filter or an SUS filter.

Further, here, the air damper 84 is provided in the manifold 86 so that vibration resulting from ink-jetting does not affect the other nozzles 36 (in order to prevent crosstalk). That is, a resin film of 20 μm or less (the air damper 84) is formed in the manifold 86 that is a resin molded part. According to the above, the inkjet recording head 32 of the first exemplary embodiment where the piezoelectric element 60 is exposed to (faces) the pressure chamber 82 is completed and, as shown in FIG. 5, the insides of the ink pool chamber 80 and the pressure chamber 82 can be filled with the ink N.

Next, an operation of the inkjet recording apparatus 10 will be described. First, when an electrical signal instructing printing is sent to the inkjet recording apparatus 10, the recording paper P is picked up one sheet at a time from the paper supply portion 24 and conveyed by the conveyance device 26. Meanwhile, in the inkjet recording heads 32, the ink pool chambers 80 of the inkjet recording heads 32 have already been injected (filled) with the inks N via the ink supply ports from the ink tanks, and the inks N filling the ink pool chambers 80 is supplied to (fills) the pressure chambers 82 via the ink supply paths 90.

At this time, in the distal end (ejection opening) of the nozzle 36, as shown in FIG. 5, a meniscus in which the surface of the ink N is slightly recessed toward the pressure chamber 82 side is formed. Then, ink droplets are selectively ejected from the plural nozzles 36 while the recording paper P is conveyed, whereby part of an image based on image data is recorded on the recording paper P.

That is, a voltage is applied to predetermined piezoelectric element 60 at a predetermined timing by predetermined drive element 50, whereby the vibrating plate 70 flexibly deforms (vibrates with out-of-plane) in the vertical direction and the ink N inside the pressure chambers 82 is pressurized and caused to be ejected as ink droplets from predetermined nozzle 36. In this manner, when an image based on image data is completely formed on the recording paper P, the recording paper P is discharged to the paper discharge portion 25 by the paper discharge belt 23. Thus, printing (image recording) on the recording paper P is completed.

Figure 13:
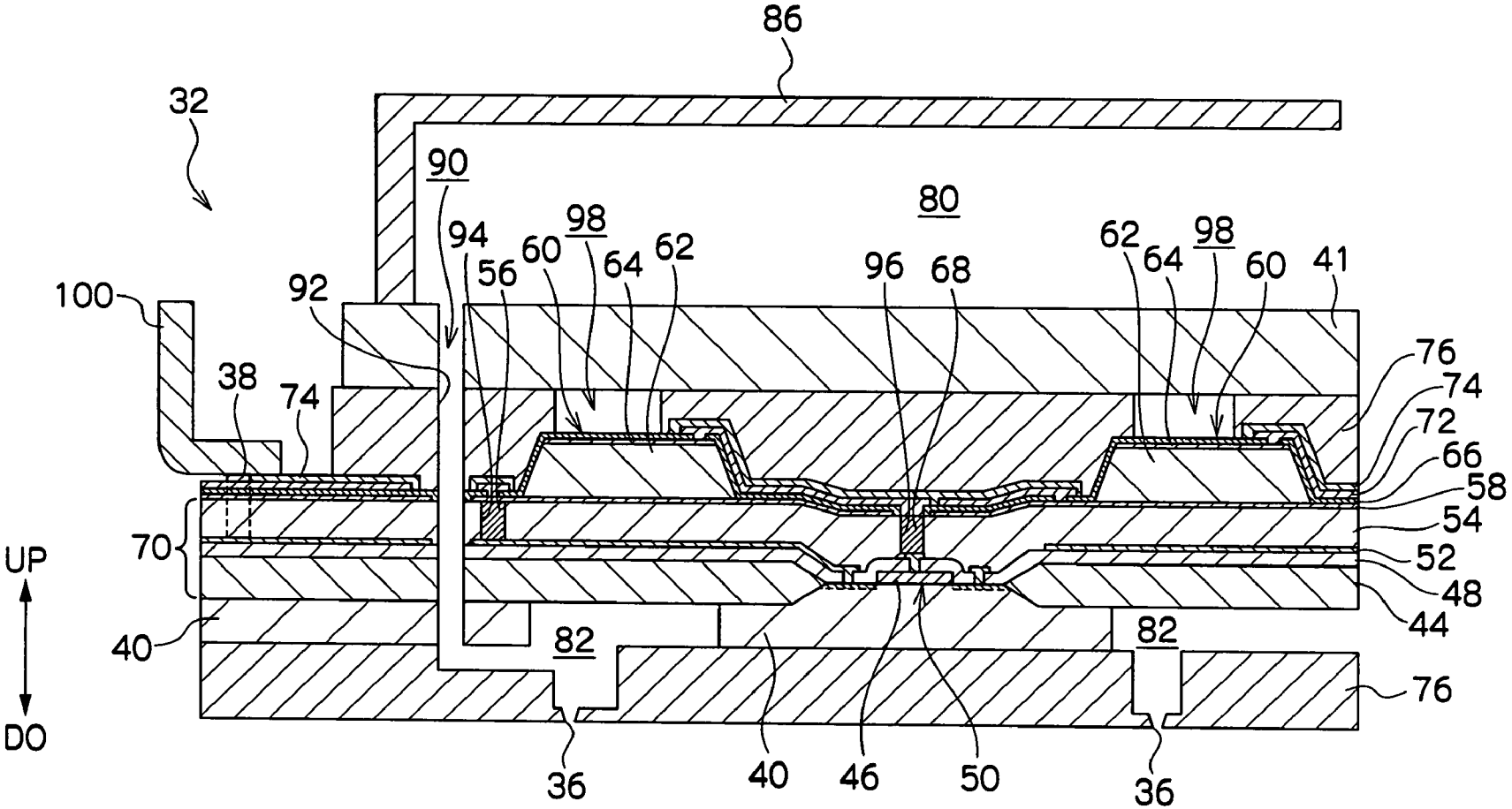
FIG. 13 is a general cross-sectional diagram showing the configuration of a second exemplary embodiment of the inkjet recording head.

Next, a second exemplary embodiment of the inkjet recording head 32 will be described. Below, configural elements and members that are the same as those of the inkjet recording head 32 of the first exemplary embodiment will be given the same reference numerals and detailed description thereof (including operation) will be omitted. As shown in FIG. 13, in the inkjet recording head 32 of the second exemplary embodiment, the side where the nozzles 36 are formed is down side. Additionally, in the inkjet recording head 32 of the second exemplary embodiment, the piezoelectric element 60 is formed on the opposite side of the pressure chamber 82 with respect to the vibrating plate 70 such that it does not face the pressure chamber 82.

That is, a top plate 41 configured by a silicon substrate or a glass substrate is laminated on the upper surface of the resin layer 76, and the ink pool chamber 80 is formed on the upper surface of the top plate 41. Additionally, the ink pool chamber 80 and the pressure chamber 82 formed on the underside of the LOCOS film 44 configuring the vibrating plate 70 are connected by the ink supply path 90 (the ink supply through opening 92) formed in the top plate 41, the resin layer 76, the vibrating plate 70 and the silicon substrate 40.

In other words, the inkjet recording head 32 of the second exemplary embodiment is configured such that the LOCOS film 44 serving as the second layer faces the pressure chamber 82. It will be noted that, in the inkjet recording head 32 of the second exemplary embodiment, an air chamber 98 serving as a cavity is formed between the top plate 41 and the piezoelectric element 60 (the TEOS film 66). Due to the air chamber 98, it does not affect the driving of the piezoelectric element 60 and the vibration of the vibrating plate 70 (the driving of the piezoelectric element 60 and the vibration of the vibrating plate 70 are allowed).

Figure 14:
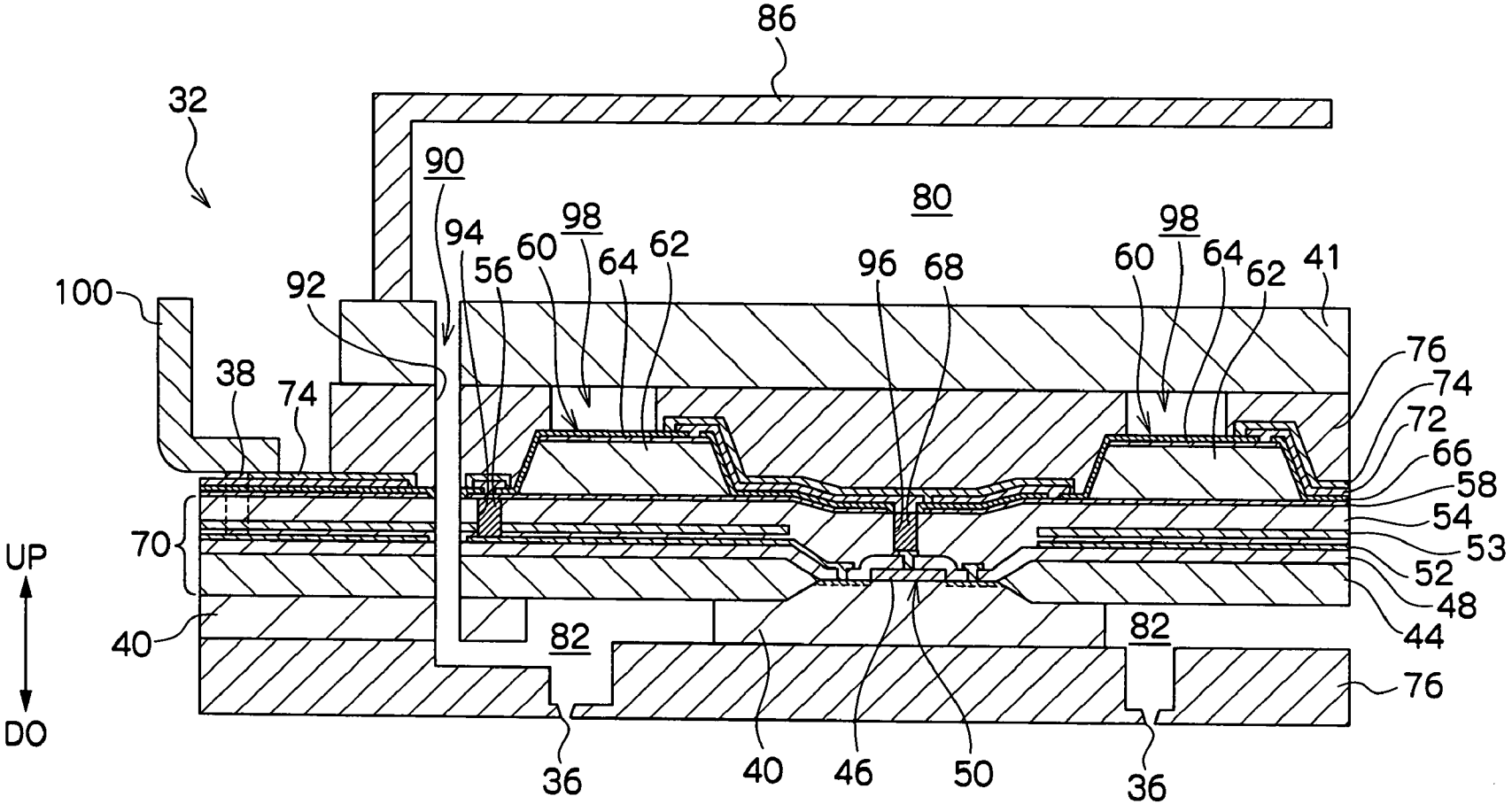
FIG. 14 is a general cross-sectional diagram showing the configuration of a third exemplary embodiment of the inkjet recording head.

Next, a third exemplary embodiment of the inkjet recording head 32 will be described. Below, configural elements and members that are the same as those of the inkjet recording head 32 of the first exemplary embodiment and the second exemplary embodiment will be given the same reference numerals and detailed description thereof (including operation) will be omitted. As shown in FIG. 14, in the inkjet recording head 32 of the third exemplary embodiment, in addition to the metal wire 52 serving as the first electrical wire, a metal wire 53 serving as a fourth electrical wire is embedded inside the vibrating plate 70 in a state where it is vertically offset from the metal wire 52.

That is, after the metal wire 52 has been formed, the TEOS film 54 is formed at a thickness of about half (film thickness: 1.6 μm), and after the metal wire 53 has been formed, the TEOS film 54 (film thickness: 1.7 μm) is formed. In this manner, when plural electrical wire layers (the metal wires 52 and 53) are disposed inside the vibrating plate 70, it becomes possible to separately use the metal wire 52 as a low-voltage electrical wire and use the metal wire 53 as a high-voltage electrical wire, for example.

Figure 15:
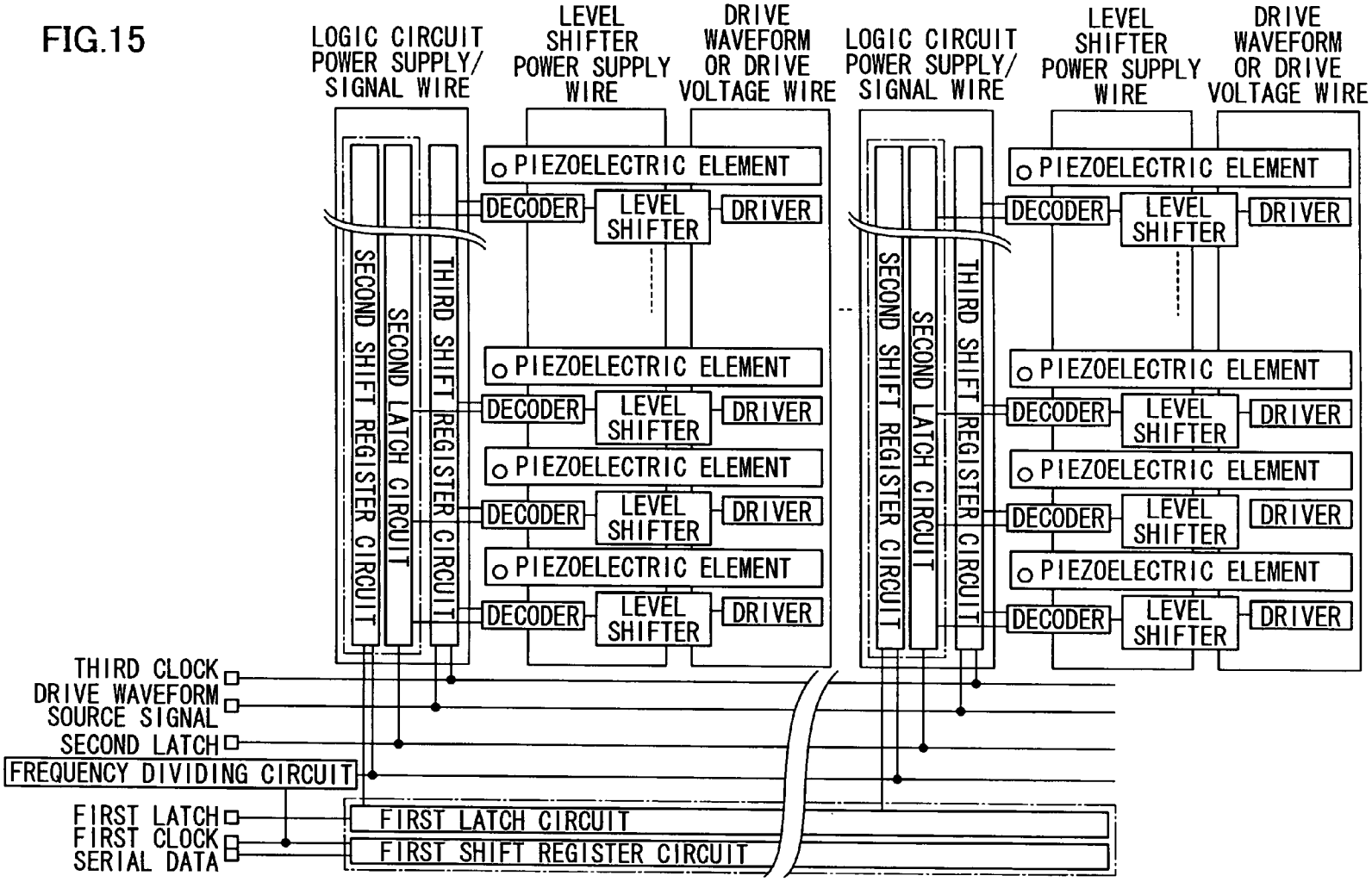
FIG. 15 is a block diagram showing the configuration of the third exemplary embodiment of the inkjet recording head.

Here, to further describe the configuration of the inkjet recording head 32 on the basis of FIG. 15, the drive element 50 is controlled by a clock signal, a drive waveform source signal and a latch signal, and is provided with a shift register circuit and a latch circuit. The clock signal and the drive waveform source signal are inputted to the shift register circuit, and the latch signal is inputted to the latch circuit. Further, a decoder, a level shifter and a driver are provided for each of the piezoelectric elements 60. In this inkjet recording head 32, it becomes possible to use the metal wire 52 as a logic circuit power supply/signal wire and to use the metal wire 53 as a level shifter power supply wire and a drive voltage wire.

Figure 16:
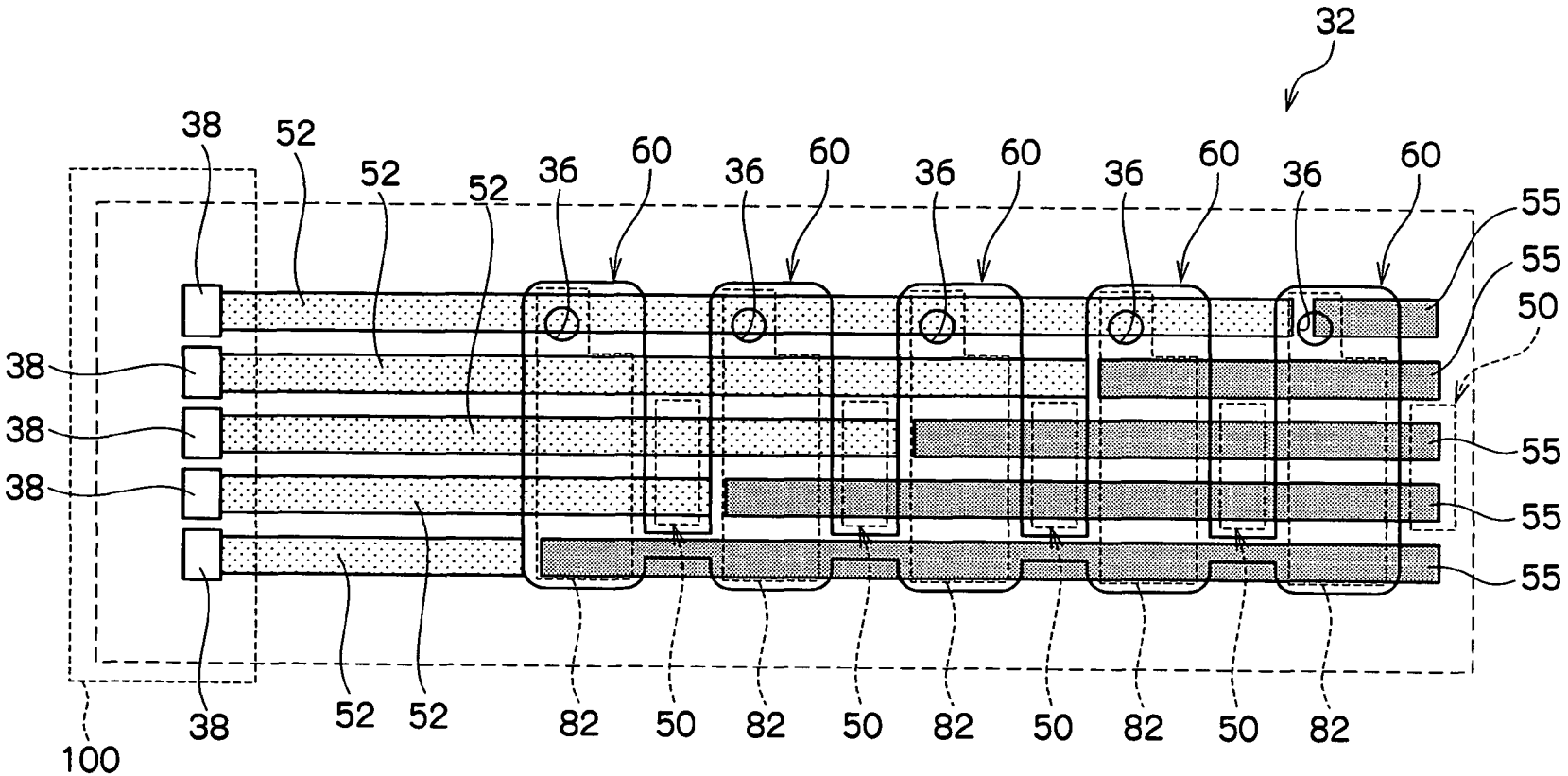
FIG. 16 is a general plan diagram schematically showing the configuration of a fourth exemplary embodiment of the inkjet recording head.

Next, a fourth exemplary embodiment of the inkjet recording head 32 will be described. Below, configural elements and members that are the same as those of the inkjet recording head 32 of the first exemplary embodiment to the third exemplary embodiment will be given the same reference numerals and detailed description thereof (including operation) will be omitted. As shown in FIG. 16, in the inkjet recording head 32 of the fourth exemplary embodiment, dummy metal wires 55 that are not electrically connected are symmetrically formed in a plan view with respect to the metal wires 52 in the same layer where the metal wires 52 are formed in order to reduce differences in the uneven shapes of the respective regions where the piezoelectric elements 60 are formed. It is preferable for the dummy metal wires 55 to be disposed so as to compensate for the portions where the metal wires 52 are not formed in the layer where the metal wires 52 are formed, such that the width of the dummy metal wires 55 is the same as that of the metal wires 52 and the lengths of the metal wires are the same in each row. That is, cross-sectional shapes of regions, except for end portions thereof, where the piezoelectric elements 60 are formed are substantially the same due to the metal wires 52 and the dummy metal electrical wires 55 being formed. However, the dummy metal wires 55 may also be disposed such that just the widths are the same or just the lengths are the same.

Figure 17:
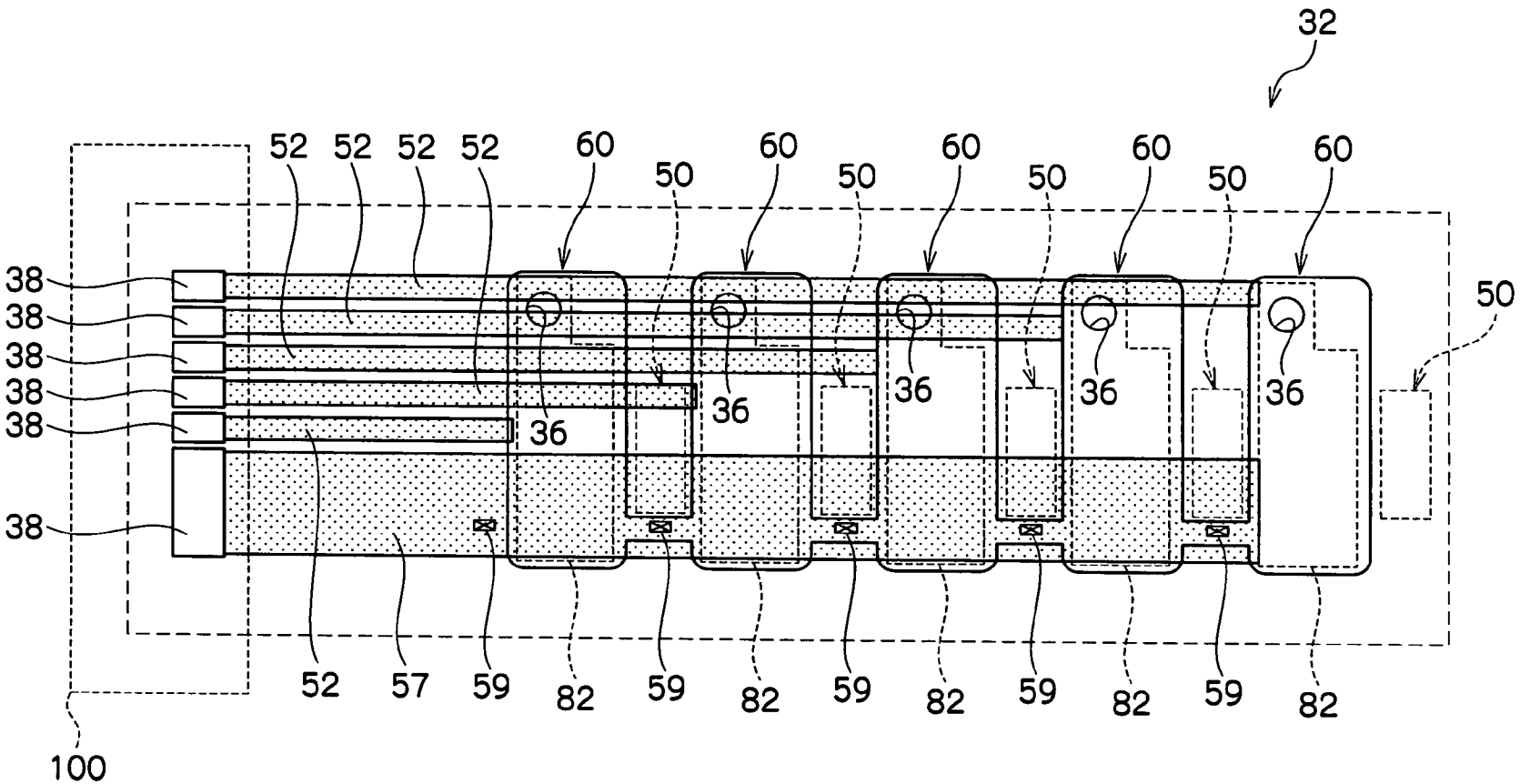
FIG. 17 is a general plan diagram schematically showing the configuration of a fifth exemplary embodiment of the inkjet recording head.

Next, a fifth exemplary embodiment of the inkjet recording head 32 will be described. Below, configural elements and members that are the same as those of the inkjet recording head 32 of the first exemplary embodiment to the fourth exemplary embodiment will be given the same reference numerals and detailed description thereof (including operation) will be omitted. As shown in FIG. 17, in the inkjet recording head 32 of the fifth exemplary embodiment, a GND metal wire 57 is disposed as a common wire and formed in the same layer where the metal wires 52 are formed in order to planarize the layer where the metal wires 52 are formed. That is, the GND metal wire 57 that connects to each of the piezoelectric elements 60 via contact portions 59 is disposed adjacent to, and so as to not overlap, the metal wires 52. Consequently, the GND metal wire 57 corresponds to the first electrical wire.

Figure 18:
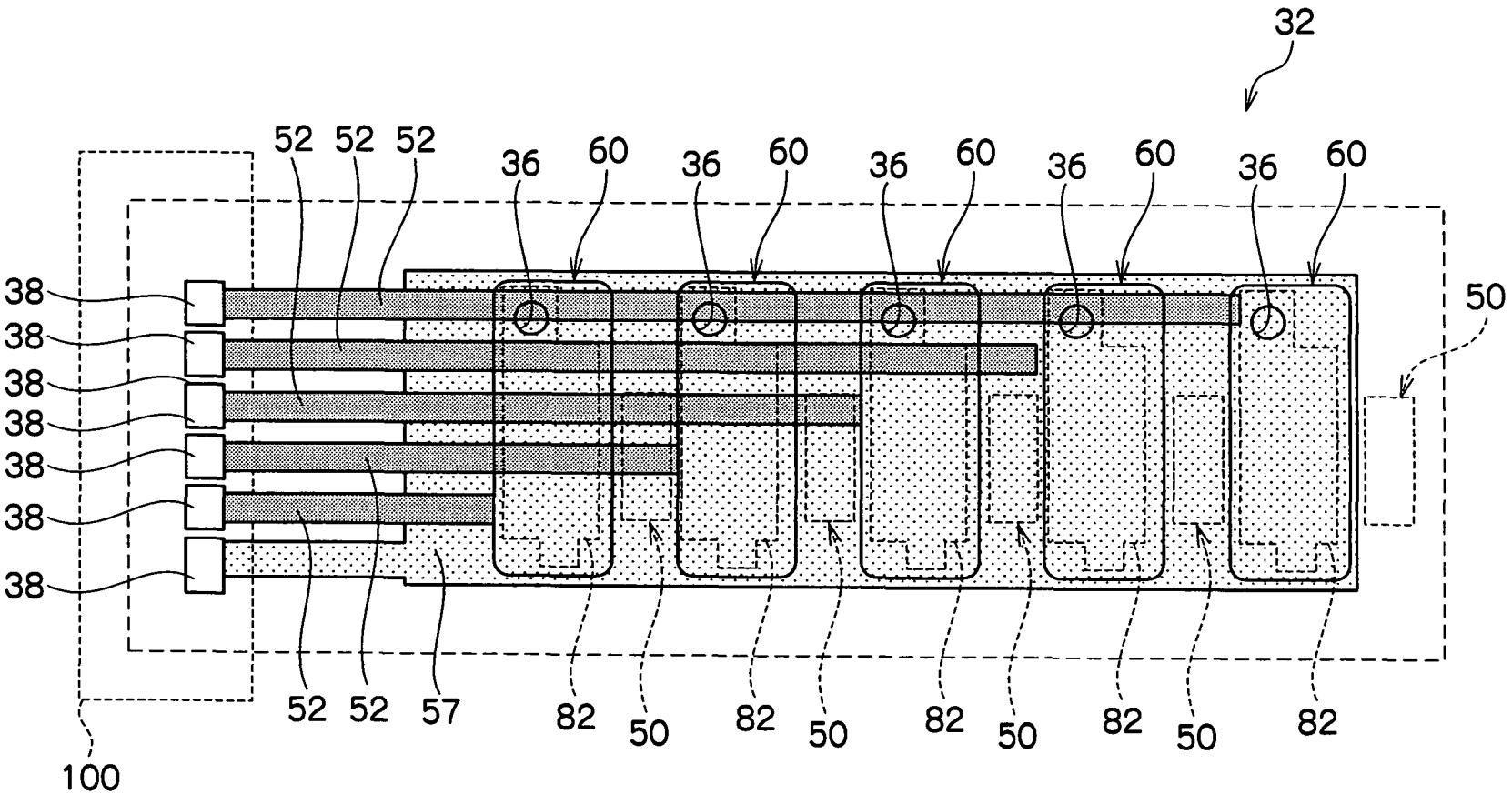
FIG. 18 is a general plan diagram schematically showing the configuration of a sixth exemplary embodiment of the inkjet recording head.

Next, a sixth exemplary embodiment of the inkjet recording head 32 will be described. Below, configural elements and members that are the same as those of the inkjet recording head 32 of the first exemplary embodiment to the fifth exemplary embodiment will be given the same reference numerals and detailed description thereof (including operation) will be omitted. As shown in FIG. 18, in the inkjet recording head 32 of the sixth exemplary embodiment, the GND metal wire 57 serving as a common wire is formed in a layer that is different from the layer where the metal wires 52 are formed. That is, the GND metal wire 57 is disposed on or under the layer where the metal wires 52 are formed so as to cover the regions in which the piezoelectric elements 60 are formed in a plan view. The GND metal wire 57 in this case corresponds to the fourth electrical wire.

What is claimed is:

1. A liquid droplet ejecting head comprising:

a piezoelectric element that includes a piezoelectric body, a first electrode disposed on one side in a liquid droplet ejecting direction of the piezoelectric body, and a second electrode disposed on the other side in the liquid droplet ejecting direction of the piezoelectric body;

a first layer on the one side of which the second electrode of the piezoelectric element is disposed;

a second layer disposed on the other side of the first layer;

a first electrical wire formed between the first layer and the second layer; and a second electrical wire extending in the liquid droplet ejecting direction that connects the first electrical wire and the second electrode.

2. The liquid droplet ejecting head of claim 1, wherein the first electrical wire is formed in a region where the piezoelectric element is formed when seen in plan view in the liquid droplet ejecting direction.

3. The liquid droplet ejecting head of claim 1, further comprising:

drive elements to which the first electrical wires are connected, each of the drive elements being disposed between the piezoelectric bodies; and third electrical wires that connect the drive elements and the first electrodes.

4. The liquid droplet ejecting head of claim 3, wherein the piezoelectric elements and the drive elements are provided in the same number.

5. The liquid droplet ejecting head of claim 3, wherein the first electrical wires are individual wires for the respective piezoelectric elements.

6. The liquid droplet ejecting head of claim 5, wherein a common wire as the first electrical wire with respect to a plurality of the piezoelectric elements is further formed.

7. The liquid droplet ejecting head of claim 6, wherein the common wire is a ground wire.

8. The liquid droplet ejecting head of claim 3, wherein dummy electrical wires are formed in a layer where the first electrical wires are formed.

9. The liquid droplet ejecting head of claim 8, wherein cross-sectional shapes of regions, except for end portions thereof, where the piezoelectric elements are formed are substantially the same due to the first electrical wires and the dummy electrical wires being formed.

10. The liquid droplet ejecting head of claim 3, wherein a common wire with respect to a plurality of the piezoelectric elements is formed such that the common wire covers, in a plan view, a region where the plurality of the piezoelectric elements are formed.

11. The liquid droplet ejecting head of claim 10, wherein the common wire is a ground wire formed on a layer different from a layer where the first electrical wires are formed.

12. The liquid droplet ejecting head of claim 1, further comprising a fourth electrical wire formed between the first layer and the second layer.

13. The liquid droplet ejecting head of claim 12, wherein the fourth electrical wire is formed on a layer different from a layer where the first electrical wire is formed between the first layer and the second layer.

14. The liquid droplet ejecting head of claim 1, wherein the piezoelectric element faces a pressure chamber filled with a liquid that is ejected from a nozzle.

15. The liquid droplet ejecting head of claim 1, wherein the second layer faces a pressure chamber filled with a liquid that is ejected from a nozzle.

16. The liquid droplet ejecting head of claim 1, wherein the second electrical wire is formed in a hole which passes through the first layer in the liquid droplet ejecting direction, such that the second electrical wire connects the first electrical wire which is disposed at the other side of the first layer and the second electrode which is disposed at the one side of the first layer.

17. A liquid droplet ejecting apparatus comprising a liquid droplet ejecting head including:

a piezoelectric element that includes a piezoelectric body, a first electrode disposed on one side in a liquid droplet ejecting direction of the piezoelectric body, and a second electrode disposed on the other side in the liquid droplet ejecting direction of the piezoelectric body;

a first layer on the one side of which the second electrode of the piezoelectric element is disposed;

a second layer disposed on the other side of the first layer;

a first electrical wire formed between the first layer and the second layer; and a second electrical wire extending in the liquid droplet ejecting direction that interconnects the first electrical wire and the second electrode.

* * * * *